US011079208B2

(12) United States Patent
Perrot

(10) Patent No.: US 11,079,208 B2
(45) Date of Patent: Aug. 3, 2021

(54) MASKING MATERIAL AND USE OF THE MATERIAL TO MASK A TARGET AND AMMUNITION FOR DISSEMINATING SUCH MASKING MATERIAL

(71) Applicant: MECAR, SOCIÉTÉ ANONYME, Seneffe (BE)

(72) Inventor: Nicolas Perrot, Ecaussinnes (BE)

(73) Assignee: MECAR, SOCIÉTÉ ANONYME, Seneffe (BE)

( * ) Notice: Subject to any disclaimer, the term of this patent is extended or adjusted under 35 U.S.C. 154(b) by 0 days.

(21) Appl. No.: 16/758,171

(22) PCT Filed: Sep. 14, 2018

(86) PCT No.: PCT/IB2018/057034
§ 371 (c)(1),
(2) Date: Apr. 22, 2020

(87) PCT Pub. No.: WO2019/081993
PCT Pub. Date: May 2, 2019

(65) Prior Publication Data

US 2020/0309494 A1 Oct. 1, 2020

(30) Foreign Application Priority Data

Oct. 23, 2017 (BE) ..... 2017/5755

(51) Int. Cl.
*F42B 12/70* (2006.01)
*F42B 12/48* (2006.01)
*F42B 33/00* (2006.01)

(52) U.S. Cl.
CPC ..... *F42B 12/70* (2013.01); *F42B 12/48* (2013.01); *F42B 33/00* (2013.01)

(58) Field of Classification Search
CPC .... F41H 3/00; F41H 9/06; F42B 12/48; F42B 12/70; F42B 12/46; F42B 12/36
(Continued)

(56) References Cited

U.S. PATENT DOCUMENTS 4,704,966 A 11/1987 Sellman et al.
5,507,956 A * 4/1996 Bonse ..... B01J 23/40 210/757

(Continued)

FOREIGN PATENT DOCUMENTS

DE 4126016 C1 11/1992
EP 0791164 B1 8/1997

(Continued)

OTHER PUBLICATIONS

International Search Report, dated Sep. 14, 2018, from corresponding PCT application No. PCT/IB2018/057034.

*Primary Examiner* — Jonathan C Weber
(74) *Attorney, Agent, or Firm* — Nixon & Vanderhye

(57) ABSTRACT

Disclosed is a masking material intended to be disseminated by an ammunition or a launcher to create a cloud that masks a target with respect to electromagnetic radiation in a given wavelengths range. This material contains at least one aluminium oxyhydroxide, such as boehmite or pseudoboehmite. Also disclosed is an ammunition enabling the dissemination of such masking material and the use of aluminium oxyhydroxide, such as boehmite or pseudoboehmite as a masking material that can be disseminated by an ammunition.

14 Claims, 2 Drawing Sheets

(58) Field of Classification Search
USPC ..... 102/505, 367
See application file for complete search history.

(56) References Cited

U.S. PATENT DOCUMENTS

| | | | | |
|---|---|---|---|---|
| 5,531,930 | A | 7/1996 | Karton et al. | |
| 5,593,781 | A | 1/1997 | Nass et al. | |
| 9,828,304 | B1 | 11/2017 | Haines et al. | |
| 2004/0247899 | A1 | 12/2004 | Bier et al. | |
| 2005/0089582 | A1* | 4/2005 | Zapf ..... | A61K 8/25<br>424/684 |
| 2010/0324193 | A1 | 12/2010 | Herbiet et al. | |

FOREIGN PATENT DOCUMENTS

| | | | |
|---|---|---|---|
| EP | 1671614 | A1 | 6/2006 |
| FR | 2396265 | A1 | 1/1979 |
| FR | 2421363 | A1 | 10/1979 |
| FR | 2730742 | A1 | 8/1996 |
| WO | 2006/115492 | A1 | 11/2006 |

* cited by examiner

MASKING MATERIAL AND USE OF THE MATERIAL TO MASK A TARGET AND AMMUNITION FOR DISSEMINATING SUCH MASKING MATERIAL

BACKGROUND OF THE INVENTION

Field of the Invention

The technical field of the invention relates to materials that enable a target to be masked.

Description of the Related Art

Masking materials are well-known in the military field. They make it possible to protect a target, for example a vehicle, by preventing its detection by enemy means.

Disseminated by a projectile, they also enable a masking cloud to be formed in an area, thereby allowing vehicles or infantry soldiers to advance towards said area, protected by the cloud.

It is thus known that maskings are created with regard to electromagnetic radiation in the visible range (radiation wavelengths from 380 nanometres to 780 nanometres) and in the infrared range (radiation wavelengths from 780 nanometres to 1 millimetre).

Taking into consideration known infrared detection technologies, the infrared ranges that most require masking from an operational point of view is the range 8-14 micrometres.

To set up infrared masking, in the field of close-defence ammunition for armoured vehicles, it is known that a powder or metallic flakes (most often brass or aluminium) are disseminated. By way of example, U.S. Pat. No. 5,531,930 describes an ammunition that disseminates aluminium flakes and patent U.S. Pat. No. 4,704,966 describes a masking material composed of brass flakes.

There have been proposals to disseminate other types of materials with a granulometry suitable for masking wavelengths in the infrared range (ranges 3-5 micrometres and 8-12 micrometres).

Among the known materials: silica powder (patent DE4126016), titanium dioxide (statutory invention registration USH769), calcium carbonate or magnesium carbonate (patent FR2396265), carbon powder or carbon nanotubes (patents FR2730742 and FR2421363).

Finally it is known to disseminate fine droplets forming a fog for masking in the visible and infrared ranges. To this end it suffices to disseminate a liquid such as titanium tetrachloride, which forms a dense cloud on contact with moisture in the air (patent EP791164).

Materials that form clouds of droplets, such as titanium tetrachloride, have the disadvantage of being highly corrosive and of forming clouds that are both corrosive and toxic, typically including hydrochloric acid. They are most often discarded in favour of the dissemination of inert materials.

Metallic powders are interesting but the mass of the block of powder required to create a masking of relatively large dimensions (height or width greater than 5 metres) will greatly increase the weight of the ammunition tasked with disseminating the material, which can destabilise the projectile in flight.

The metallic material can also become compacted as the ammunition is stored, leading to masking performances different from those initially expected, and can possibly destabilise the projectile in flight by shifting the centre of gravity.

Moreover, for the resulting masking to have a certain duration, the material particles must have a sufficiently reduced rate of descent.

Flake-shaped particles are therefore most often used, so as to slow down the descent. U.S. Pat. No. 4,704,966 thus describes a masking material composed of copper or brass flakes.

However, copper or brass is sensitive to corrosion and has too high a density to make projectiles allowing for the creation of sizable masking and at a distance.

U.S. Pat. No. 5,531,930 suggested using aluminium flakes. However, such flakes must be coated to reduce the risk of agglomeration in the body of the ammunition, which complicates the manufacturing process of the ammunitions. Moreover, small-particle aluminium is pyrophoric, i.e. it can ignite spontaneously at ambient temperatures. It is therefore dangerous to use and its dissemination as a cloud in the field can cause fires.

SUMMARY OF THE INVENTION

The aim of the invention is therefore to propose a material with a reduced mass and a good masking efficiency relative to electromagnetic radiation in a given wavelengths range.

The invention thus provides masking in the visible range but also, advantageously, in the infrared range, in particular in the ranges 3-5 and 8-14 micrometres.

The material according to the invention is of simple industrial application and does not present any risk of use.

In particular, this material is compatible with the European REACH regulations.

The invention also provides masking ammunition that uses such material and enables dissemination thereof in the field.

Hence, the object of the invention is the use of aluminium oxyhydroxide, such as boehmite or pseudoboehmite, as masking material that can be disseminated by an ammunition to ensure masking of a target relative to electromagnetic radiation in a given wavelengths range.

Advantageously, the invention proposes a use in which the aim is to mask infrared wavelengths ranges, as the granulometry of aluminium oxyhydroxide is between 1 and 100 micrometres, with at least 90% of the material particles having an average diameter of between 25 and 45 micrometres.

The object of the invention is also a masking material designed to be disseminated by an ammunition to create a cloud that masks a target from electromagnetic radiation in a given wavelengths range, the material being characterised in that it comprises at least one aluminium oxyhydroxide, such as boehmite or pseudoboehmite.

Advantageously, this masking material is effective in a range of infrared wavelengths and the aluminium oxyhydroxide has a granulometry of between 1 and 100 micrometres with at least 90% of the material particles having an average diameter of between 25 and 45 micrometres.

According to a variant of the embodiment, the aluminium oxyhydroxide can be coated with a binding agent.

The binding agent may, in particular, comprise polyvinyl alcohol (PVA).

Finally, the object of the invention is a masking ammunition comprising a shell containing a masking material and a pyrotechnic dissemination charge that can be activated by a rocket, said ammunition being characterised in that the masking material comprises a material according to the invention.

According to one embodiment, the dissemination charge is composed of at least one explosive material arranged in a metallic dissemination rod closed off at the end furthest from the rocket, the rod extending axially through the masking material coaxially along the axis of the ammunition.

Advantageously, the masking material can contain at least one bloc compressed directly inside the shell and around the dissemination rod.

According to a particular embodiment, the masking material can be compressed inside the shell without the use of a binding agent.

BRIEF DESCRIPTION OF THE DRAWINGS

The invention will be better understood on reading the following description of the particular embodiments, reference in the description being made to the annexed drawings in which.

DESCRIPTION OF THE PREFERRED EMBODIMENTS

Boehmite and pseudoboehmite are aluminium oxyhydroxides with a generic formula AlO(OH). Boehmite is a material that naturally exists in bauxite ore. It is a hydrated alumina with a lamellar orthorhombic crystalline structure.

Pseudoboehmite is a common designation for finely crystallised boehmite, containing more water than boehmite, and composed of separate octahedral crystalline layers separated by water molecules. The publication "Crystal chemistry of Boehmite by Rodney Tettenhorst and Douglas A Hofman (Clays and clay minerals vol 28, no 5, 373-380, 1980)" describes comparative syntheses of boehmite and pseudoboehmite and their crystallographic comparisons.

These materials are easy to procure and are commonly used in industry for the preparation of abrasives, ceramic coatings, inks, paper, catalysts, . . . .

They are also used as intermediate products in aluminium metallurgy.

These materials have to date never been used in the armament field and, in particular, have never been incorporated as a charge in a smoke-generating ammunition.

The tests carried out by the applicant showed that boehmite and, more specifically, finely crystallised boehmite or pseudoboehmite, can be disseminated in the air as a cloud and that the clouds thus created had a certain durability, enabling a target to be masked, for example in the visible field.

In particular, it has been found that the falling speed of the cloud particles is relatively slow, with falling speeds below 1 m/s.

Figure 1A:
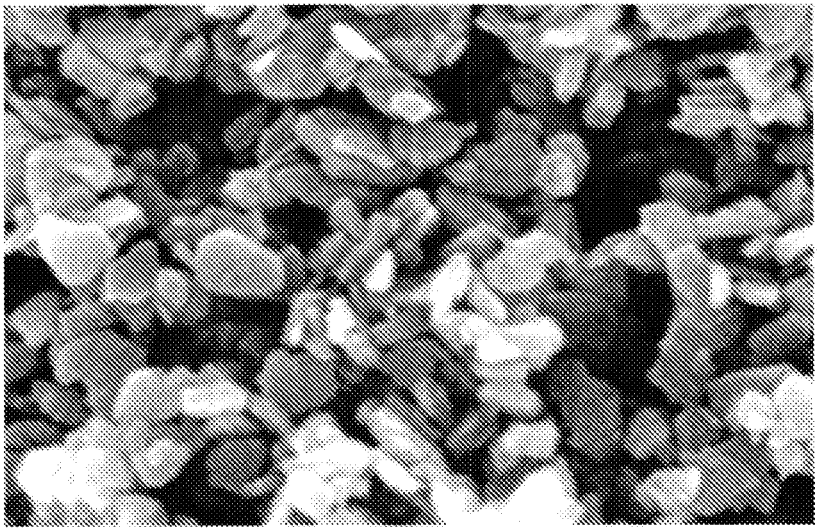
FIG. 1*a* is a micro photograph of a first example of particles of a material according to the invention.
Figure 1B:
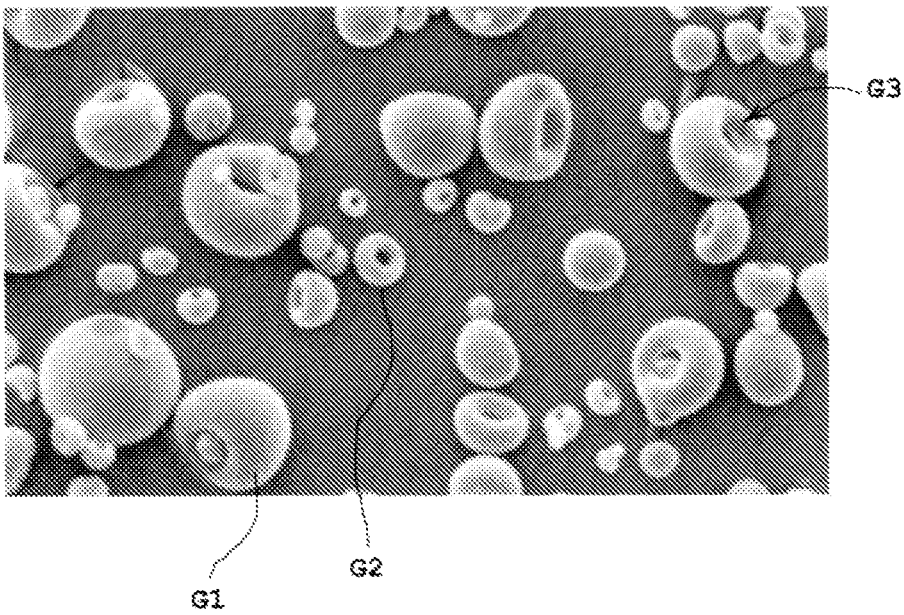
FIG. 1*b* is a micro photograph on a greater scale of a second example of particles of a material according to the invention.

Such behaviour is due, on the one hand, to the reduced mass of the material, the average density of the material being in the range of 3 to 3.07 and the apparent density of the non-compacted bulk powder being below 1.5 and, on the other hand, to the fineness of the boehmite crystals that are morphologically in the shape of flakes or leaves as illustrated in the microscopic photograph of FIG. 1*a*, or sphere-shaped with a median depression as shown in FIG. 1*b*).

These shapes allow the particles to fall slowly and the cloud to be durable, in addition to a low wind sensitivity of the cloud.

The powder of the material according to the invention has numerous advantages.

From the point of view of the loading process of an ammunition body, this powder is not a material classified in a pyrotechnic risk class.

Filling an ammunition body is easy. No particular personal protective equipment is required, except a dust mask and safety goggles.

Ammunition can be loaded in bulk or by compression, however the masking performances of a compressed charge will be better.

Compression loading will be carried out using conventional, low-cost equipment, such as a hydraulic press.

From the point of view of the intrinsic properties of the powder, the latter is inert, as opposed to powdered aluminium.

The apparent density of bulk powder is below 1.5, the material is thus particularly light.

The cloud created by the suspension of this powder is not corrosive and very low in toxicity for humans and the environment.

By a judicious choice of granulometry, the resulting cloud allows for masking in the infrared ranges from 3 to 5 and 8 to 14 micrometres and in the visible spectrum. Masking is mainly achieved by absorption of radiation.

Moisture in the air or oxygen levels have little influence on the effectiveness of the aerosol. The powder does not react with either air or atmospheric water.

Boehmite or pseudoboehmite powder is commercially available for different kinds of granulometries.

This powder is generally produced by a conventional sol-gel type process including a hydrolysis and condensation stage of an aluminium alkoxide with excess water to create an aluminium hydroxide, a re-dissolution stage of the precipitate obtained to create the Sol, then Gel creation by drying the Sol.

This Sol-Gel process was developed by B.E Yoldas. For further details about the Sol-Gel processes one can consult the publication "Handbook of Sol-Gel science and technology" by Sumio Sakka (ISBN: 1-4020-7968-0).

The fineness and morphology of the particles of boehmite or pseudoboehmite can be modified by using a spray drying tower. Such a tower ensures that boehmite or pseudoboehmite industrial Gel solutions are dried while making it possible to calibrate the desired granulometry.

Spray towers are well known in the field of industrial processes for the production of powdered materials and it is therefore not necessary to describe them in more detail.

This spray drying tower will be set at d(0.9) in such a way as to obtain a powder with a granulometry of between 25 and micrometres, i.e. with 90% of the material particles having an average diameter of between 25 and 45 micrometres, furthermore the overall granulometry will be between 1 micrometre and 100 micrometres. In a conventional way, increasing the spraying pressure allows for a reduction in the size of the powder particles.

Such a choice of granulometry leads to sphere-shaped particles G1,G2 with a median depression G3 as shown in FIG. 1*b*). Moreover, this granulometry ensures masking of infrared wavelengths in the ranges from 3 to 5 and 8 to 14 micrometres.

By way of variant, the aluminium oxyhydroxide particles can be coated with a binding agent.

Such a variant will enable an increase in the size of the particles formed and facilitate their subsequent compaction in an ammunition. It also makes it possible to limit the dissemination of the material particles during the manufacturing stages, in particular by limiting the level of dust.

The binding agent may, for example, comprise polyvinyl alcohol (PVA) in a proportion of 1% to 4% in mass.

The binding agent is incorporated into the solution of aluminium oxyhydroxide particles in the water and before spraying.

Figure 2:
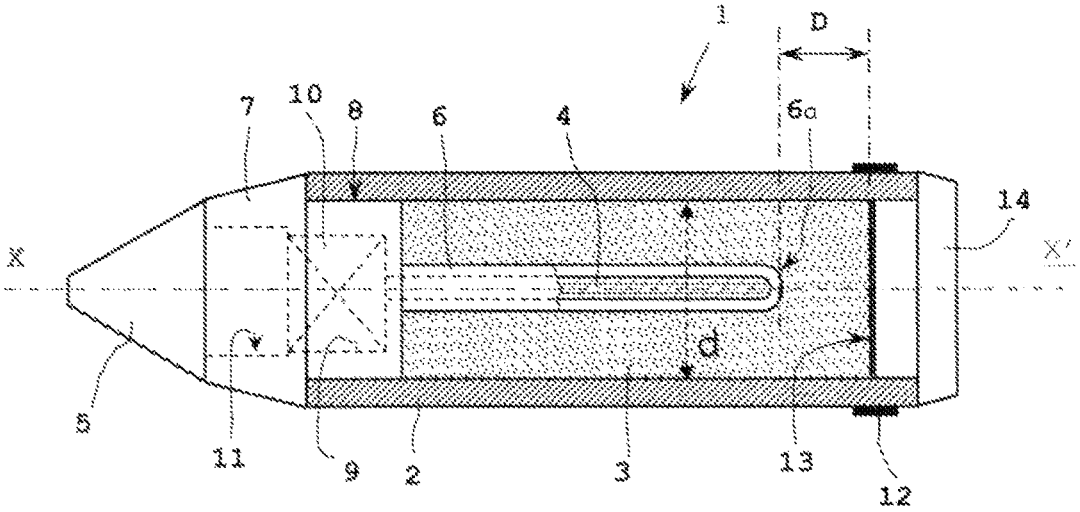
FIG. 2 is a longitudinal cross-sectional view of an ammunition according to an embodiment of the invention.

FIG. 2 shows in a longitudinal cross-section an example of an embodiment of a masking ammunition 1 according to the invention, the ammunition being in a conventional projectile shape with a rotational axis of symmetry X-X'.

This ammunition is intended to be fired by a weapon system, not shown, in the direction of an area of land. Its function is to generate an infrared or visible masking cloud in said area.

This ammunition 1 comprises a shell 2 containing a masking material 3 and a pyrotechnic dissemination charge 4 that can be activated by a rocket 5, such as a chronometric-type rocket able to dissipate a flame in the axial direction X-X'.

The shell has at its rear a belt 12 ensuring in a conventional way gas-tightness during firing in the tube of a weapon.

The dissemination charge 4 is composed of at least one explosive material, for example pellets of an explosive combining hexogen and wax or a composite explosive, which is arranged in a metal dissemination rod 6 closed off at its end 6*a* furthest from the rocket.

The rod 6 is connected to a connecting ring 7 that is affixed to the shell 2, for example by a thread 8. The rod 6 extends axially through the masking material 3 in the direction of the axis X-X' of the ammunition 1.

The connecting ring 7 is preferably made in one piece with the rod 6. For example, this assembly will be made of aluminium to reduce the mass of the ammunition.

The connecting ring 7 contains an internal chamber 9 that receives a detonation relay 10 and communicates with the cavity of the rod 4. It also includes a threading 11 to attach the rocket 5.

The quantity of explosive of the dissemination charge 4 is sufficient to ensure the bursting, both of the rod 6 and the shell 2 of the ammunition.

When the ammunition is launched by a canon, for example, to mask a target, at a given moment in the trajectory of the ammunition or by the impact of the ammunition, the rocket 5 triggers the initiation of the detonation relay 10, which in turn initiates the dissemination charge 4.

The burst of the dissemination charge 4 puts a strain on the masking material 3 which causes the shell 2 of the ammunition to burst and the dissemination of the masking material 3.

In order to improve the spread of the masking cloud, the rod 6 will be of a length such that at the back of the rod 6 a distance D will remain, at least equal to half the internal diameter of the shell 2. Such an arrangement avoids reducing the density of the masking cloud at its centre. A rod 6 that is too long risks creating an annular cloud.

The masking material 3 is a material comprising essentially aluminium oxyhydroxide, such as boehmite or pseudoboehmite, the particles of which can be coated with a binding agent such as polyvinyl alcohol (PVA).

Preferably, the material 3 is placed in the shell 2 by compression directly in the shell. This produces at least one compressed block directly inside the shell 2 and around the dissemination rod 6.

According to this embodiment of the invention, the shell 2 holds the connecting ring 7 continued by the rod 6. Using a piston drilled to the diameter of the rod 6, it is easy to carry out in situ compression of the masking material 3, without the need for subsequent processing of the compressed block to allow for the passage of the rod 6. As a result, it is very easy to manufacture the ammunition 1.

Compression can be carried out in one or more rounds depending on the length of the ammunition 1.

Wedging disks 13 will be placed between the back of the bloc of masking material 3 and a base 14 closing off the shell 2 at the rear. The disks are used to compensate for manufacturing tolerances over the length of the compressed block of masking material 3 such that the bloc is properly immobilised axially in the ammunition 1.

It should be noted that the dissemination charge 4 can only be put in place after the masking material 3 has been loaded. Compression operations of the masking material 3 are therefore carried out on a completely inert ammunition 1.

According to a particularly advantageous embodiment, the masking material 3 can be compressed inside the shell 2 without the use of a binding agent. However, in that case a solvent can be added to the masking material, for example methyl ethyl ketone in a reduced proportion (5% to 20% in mass), to limit dust. The solvent can or cannot be removed by vacuum drying before the base 14 is fitted.

The tests carried out made it possible to verify that the masking material 3 according to the invention was easy to compress, even without a binding agent. The resulting block is particularly compact and solid. No risk of dislocation during firing is to be feared. No settling of the masking material during storage is to be feared either.

It is obvious that the powder of the masking material can be compressed in a separate mould to form a compressed block that can be manipulated for insertion into the shell 2.

Alternatively, it is not excluded to fill the shell 2 by pouring the non-compressed powder into the shell 2 and to put in place the base 14 without having compressed the powder beforehand.

Surprisingly, the energy conveyed by the dissemination charge 4 when it is activated is enough to fragment the bloc of masking material which outside the shell 2 becomes once again a powdered material creating the desired masking cloud and with the expected performances, in particular in the infrared range.

It is of course possible to make ammunitions 1 according to the invention that are not fired by a canon or a mortar tube but which equip the launcher tubes of close-defence ammunition of armoured vehicles. In that case, the masking cloud will have the effect of masking the vehicle firing the ammunition according to the invention.

Clearly, the aluminium oxyhydroxide as masking material 3 need not necessarily be in the form of boehmite or pseudoboehmite.

It is obvious that the invention is by no means limited to the examples described above, but that numerous modifications can be made to the ammunition and the masking material, as well as to the method described above without departing from the scope of the invention as defined in the following claims.

The invention claimed is:

1. A method of masking a target with respect to electromagnetic radiation in a range of given wavelengths, comprising:

providing aluminium oxyhydroxide as a masking material; and disseminating the masking material by an ammunition or launcher.

2. The method according to claim 1, wherein the aluminium oxyhydroxide is used in powdered form, whether or not compressed, with a granulometry of between 1 and 100 micrometres, with at least 90% of particles (G1,G2) of the masking material (3) having an average diameter of between 25 and 35 micrometres.

3. The method according to claim 2, wherein the aluminium oxyhydroxide is disseminated by means of an explosive ammunition comprising aluminium oxyhydroxide powder, whether or not in compressed form.

4. The method according to claim 1, wherein the range of given wavelengths comprises infrared wavelengths from 8 to 14 micrometres, infrared wavelengths from 3 to 5 micrometres, and visible wavelengths.

5. The method according to claim 1, wherein the aluminium oxyhydroxide is disseminated as a cloud.

6. Masking ammunition, comprising:

a shell containing a masking material (3); and a pyrotechnical dissemination charge (4) that can be activated by a rocket (5), wherein the masking material (3) is configured to create a cloud ensuring masking of a target with respect to electromagnetic radiation in a given wavelengths range, said masking material (3) comprising at least one aluminium oxyhydroxide.

7. The masking ammunition according to claim 6, wherein the pyrotechnical dissemination charge (4) is composed of at least one explosive material arranged in a dissemination rod (6) closed off at an end of the rod (6*a*) furthest from the rocket (5), the dissemination rod (6) extending axially through the masking material (3) and along the axis of the ammunition.

8. The masking ammunition according to claim 7, wherein the dissemination rod (6) is a metallic rod.

9. The masking ammunition according to claim 7, wherein the masking material (3) is contained in the shell (2) by a base (14) that ensures that the shell (2) is closed off at a rear of the shell, and wherein a length of the dissemination rod (6) is such that there remains an axial distance (D) between the rod (6) and the base (14).

10. The masking ammunition according to claim 9, wherein the axial distance (D) between the rod (6) and the base (14) is at least equal to half of an internal diameter (d) of the shell (2).

11. The masking ammunition according to claim 7, wherein the explosive material of the pyrotechnic dissemination charge (4) comprises pellets of an explosive combining hexogen and wax or of a composite explosive.

12. The masking ammunition according to claim 11, wherein a quantity of explosive of the dissemination charge (4) is sufficient to ensure bursting of the rod (6) and the shell (2).

13. The masking ammunition according to claim 6, wherein the masking material (3) comprises at least one bloc compressed directly inside the shell (2) and around the dissemination rod (6).

14. The masking ammunition according to claim 13, wherein the masking material (3) is compressed inside the shell (2) without use of a binding agent.

* * * * *